US007924126B2

(12) United States Patent
Hait et al.

(10) Patent No.: US 7,924,126 B2
(45) Date of Patent: Apr. 12, 2011

(54) HIGH FIELD SUPERCONDUCTING MAGNETS

(75) Inventors: Thomas P. Hait, Laurel, MD (US); Peter J. Shirron, Silver Spring, MD (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 102 days.

(21) Appl. No.: 12/555,634

(22) Filed: Sep. 8, 2009

(65) Prior Publication Data

US 2011/0057752 A1 Mar. 10, 2011

(51) Int. Cl.
*H01F 6/00* (2006.01)

(52) U.S. Cl. ..... 335/216; 505/879

(58) Field of Classification Search ..... 335/216; 336/DIG. 1; 505/211–213, 230–232, 704, 505/705, 876–880

See application file for complete search history.

(56) References Cited

U.S. PATENT DOCUMENTS

| | | | | |
|---|---|---|---|---|
| 3,281,736 | A * | 10/1966 | Kunzler et al. | 335/216 |
| 3,796,553 | A * | 3/1974 | Daunt | 428/567 |
| 5,319,333 | A * | 6/1994 | Roth et al. | 335/216 |
| 6,020,803 | A * | 2/2000 | Wheatley et al. | 335/216 |
| 6,600,398 | B2 * | 7/2003 | Roth et al. | 335/216 |
| 7,015,779 | B2 * | 3/2006 | Markiewicz et al. | 335/299 |
| 2006/0066429 | A1 * | 3/2006 | Kasten | 335/296 |

* cited by examiner

*Primary Examiner* — Ramon M Barrera
(74) *Attorney, Agent, or Firm* — Christopher O. Edwards

(57) ABSTRACT

A superconducting magnet includes an insulating layer disposed about the surface of a mandrel; a superconducting wire wound in adjacent turns about the mandrel to form the superconducting magnet, wherein the superconducting wire is in thermal communication with the mandrel, and the superconducting magnet has a field-to-current ratio equal to or greater than 1.1 Tesla per Ampere; a thermally conductive potting material configured to fill interstices between the adjacent turns, wherein the thermally conductive potting material and the superconducting wire provide a path for dissipation of heat; and a voltage limiting device disposed across each end of the superconducting wire, wherein the voltage limiting device is configured to prevent a voltage excursion across the superconducting wire during quench of the superconducting magnet.

20 Claims, 3 Drawing Sheets

HIGH FIELD SUPERCONDUCTING MAGNETS

The invention described herein was made by an employee of the United States Government, and may be manufactured and used by or for the Government for governmental purposes without the payment of any royalties thereon or therefore.

BACKGROUND OF THE INVENTION

This disclosure relates generally to superconducting magnets, and more particularly, to a superconducting magnet having a very high field-to-current ratio. The disclosure also relates to a method of producing the superconducting magnets, as well as uses thereof.

Superconducting magnets are those magnets fabricated, or selected winding materials that, when operated at cryogenic temperatures, exhibit essentially zero resistance to the flow of current. Accordingly, magnetic fields can be produced and maintained with considerably less power than required for magnets of conventional construction.

Whenever any portion (or all) of a superconducting magnet is quenched, i.e. becomes resistive rather than superconducting, a large amount of energy must be dissipated. This released energy can create extreme heating conditions at the point where such a quench initiates. The heating problem is normally addressed by preventing localized concentration of the heat coupled with a transfer of heat to the mandrel and heat sink.

Current superconducting magnets for producing strong magnetic fields, such as four (4) Tesla or more, require strong currents, such as ten (10) amperes or more. Often, even greater currents in the range of several hundred amperes can be required for superconducting magnets. Even the lowest of these currents requires a sizable current source and sizable power cables leading to the magnet, thus increasing the heat load on the cryogenic system. Moreover, the size and weight of current superconducting magnets tend to increase in relation to the higher magnetic field strengths desired.

There are many applications for a superconducting magnet where even a minimum of these conditions are detrimental to the efficiency of the system. For example, it is desired that superconducting magnets for space applications use much smaller currents without sacrificing the achievable magnetic fields. This would significantly reduce the size of power supplies as well as reduce the load on any cryogenic system needed to achieve the required lowered temperatures for superconductivity. Moreover, for many applications and space applications in particular, it is desirable for the system to be as compact and/or lightweight as possible. An Adiabatic Demagnetization Refrigerator (ADR) system is one such example.

An ADR system produces cooling (or heating) by the interaction of a refrigerant material in the bore of a superconducting magnet. The magnetic field of the superconducting magnet is ramped up causing the material to heat. Likewise, ramping down the magnetic field down causes it to cool. In some applications, the superconducting magnet is employed in an environment close to absolute zero. A conventional ADR system is a "single-shot" ADR. In this type of ADR system the refrigerant material continues to be magnetized, generating heat, which flows to a heat sink. This continues until full field is reached. At full magnetic field, a heat switch is deactivated and the refrigerant material is thermally isolated from the heat sink. The refrigerant material is then demagnetized to cool it to the desired operating temperature.

In general, the refrigerant material will then be receiving heat from components parts. The heat is absorbed and operating temperature maintained by slowly demagnetizing the refrigerant at a predetermined rate. Heat can continue to be absorbed until the magnetic field is reduced to zero, at which point the ADR has run out of cooling capacity.

Over the last few years there has been a growing need for more advanced ADR cooling technology. The space industry has been a pioneer in this technology because ADRs are the only low temperature (below 0.2° K) refrigeration technology that does not use any fluids, and therefore does not have the design constraints imposed by gravity. The trend in developing ADRs is toward using continuously operating multiple cooling stages, as this arrangement allows for greater efficiency by reducing parasitic heat flows within the refrigerator, and greater operating temperature range. In this process, each stage requires a superconducting magnet. In particular for space applications, each stage of the continuously operating ADR systems requires smaller, lighter-weight superconducting magnets than are currently available.

Accordingly, there is a need for smaller, lighter-weight superconducting magnets capable of achieving high magnetic field strengths at low currents.

BRIEF DESCRIPTION OF THE INVENTION

According to one aspect of the invention a superconducting magnet comprises an insulating layer disposed about the surface of a mandrel; a superconducting wire wound in adjacent turns about the mandrel to form the superconducting magnet, wherein the superconducting wire is in thermal communication with the mandrel, and the superconducting magnet has a field-to-current ratio equal to or greater than 1.1 Tesla per Ampere; a thermally conductive potting material configured to fill interstices between the adjacent turns, wherein the thermally conductive potting material and the superconducting wire provide a path for dissipation of heat; and a voltage limiting device disposed across each end of the superconducting wire, wherein the voltage limiting device is configured to prevent a voltage excursion across the superconducting wire during quench of the superconducting magnet.

According to another aspect of the invention, a method of making a superconducting magnet comprises covering a surface of a mandrel with an electrically insulating layer; winding a superconducting wire over the insulating layer onto the mandrel; simultaneously with the winding of the superconducting wire, These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
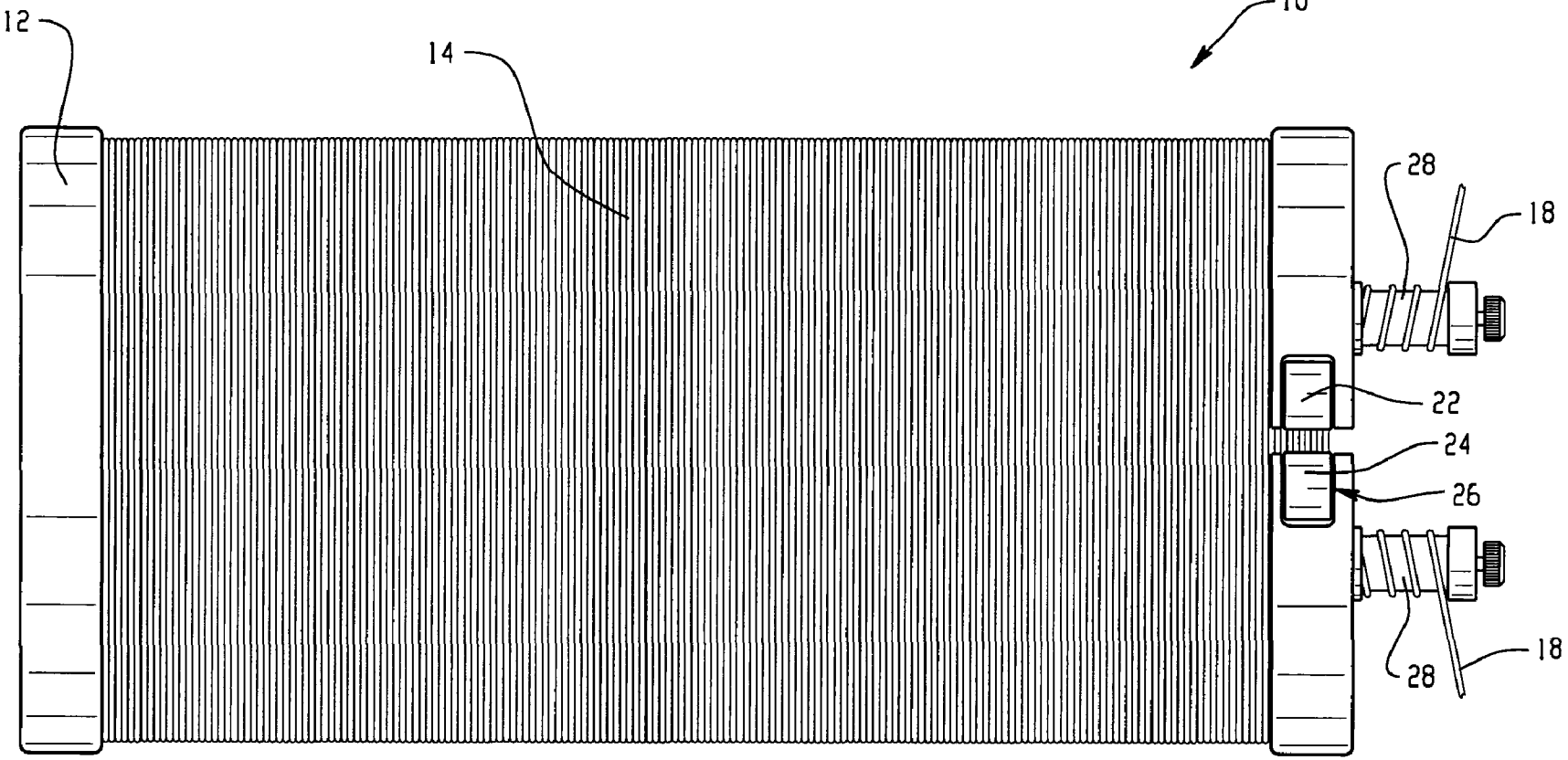
FIG. 1 is a schematic diagram of an exemplary embodiment of a superconducting magnet.

The detailed description explains embodiments of the invention, together with advantages and features, by way of example with reference to the drawings.

DETAILED DESCRIPTION OF THE INVENTION

Described herein is a superconducting magnet, and more particularly, a superconducting magnet having a very high field-to-current ratio. Also described herein is a method of producing the superconducting magnets, as well as uses thereof. The superconducting magnet includes a superconducting wire wound upon a mandrel to form a magnet. The superconducting wire is kept under a predetermined tension during winding to ensure the wire retains thermal contact with the mandrel as the magnet is cooled down. The total number of windings for the magnet is about 60,000 to about 120,000. Of course, the number of windings will depend on factors such as mandrel dimensions, wire diameter, winding tension, and the like. In an exemplary embodiment, the superconducting magnet has about 3,000 to about 20,000 turns per centimeter; specifically about 7,000 to about 14,000 turns per centimeter. A thermally conductive epoxy fills the interstices between winds of wire to prevent movement of wire that could precipitate a quench, and to provide dissipation of heat and prevent thermal damage during quench of the magnet. The magnet further includes a layer of insulation disposed between the mandrel surface and the superconducting wire to provide electrical insulation between the wire and the mandrel. Terminal leads extend from the winding region and pass through a voltage limiting device to prevent damage to the superconducting wire by voltage spikes during quench of the magnet.

The superconducting magnet described herein represents an improvement over existing superconducting magnets. The superconducting magnet is able to achieve higher field-to-current ratios than is currently available from current magnets. In an exemplary embodiment, the superconducting magnet has a field-to-current ratio of equal to or greater than 1.1 Tesla per ampere (T/A); specifically equal to or greater than 1.2 T/A; more specifically equal to or greater than 1.3 T/A; even more specifically equal to or greater than 1.4 T/A; even more specifically equal to or greater than 1.5 T/A; and still more specifically equal to or greater than 1.55 T/A. Moreover, the superconducting magnet described herein is able to achieve these very high field-to-current ratios in a compact size; smaller than that of current superconducting magnets that achieve similar field strengths. The superconducting magnet also requires less magnetic shielding to reduce fringing fields, can be cooled down rapidly without risk of damaging the wiring, can be ramped up and down in field at very high rates, generates a minimum amount of hysteresis heat, and because less current is required to generate a given magnetic field, the heat load upon a cryogenic system from the leads is minimized. As such, the superconducting magnet can be advantageously used in any system that requires a superconducting magnet or that would benefit from such high magnetic fields at low current. In an exemplary embodiment, one or more superconducting magnets are used in an Adiabatic Demagnetization Refrigerator (ADR) system.

FIG. 1 is a schematic diagram of an exemplary embodiment of a superconducting magnet 10. The superconducting magnet 10 comprises a mandrel 12 with a superconducting wire 14 wound thereabout. As used herein, the term "mandrel" is generally intended to refer to any surface upon which to wind the superconducting wire 14 and support the wire once wound upon the surface. The mandrel 12 surface is in thermal communication with the superconducting wire to aid in dissipating heat from the wires to a heat sink in physical communication with the mandrel 12. In some embodiments, the mandrel 12 can even act as the heat sink. The shape of the mandrel 12 is configured to provide a surface on which to wind the superconducting wire 14 and to support and hold the wire in place. The shape of the mandrel can vary and will depend on the desired application of the superconducting magnet. The mandrel 12 in FIG. 1 has a cylindrical shape with a smaller diameter in the center where the wire is wound and a larger diameter at either end. Such a spool-like shape provides an area on which to wrap the superconducting wire into one or more layers until the wire is wrapped to a diameter equal to that of the end diameters. In another embodiment, the diameter of the winding region can be greater than or less than the end diameters. The mandrel 12 is comprised of an electrically conductive, non-magnetic metal. Exemplary mandrel metals can include, without limitation, aluminum and its alloys, magnesium, copper, titanium and its alloys, stainless steel, silver, platinum, and the like. In some embodiments, it may be undesirable for the mandrel 12 to be comprised of superconducting material. In such an embodiment, certain metals, depending on the temperature at which the magnet must create field, will be undesirable (e.g., aluminum below 1.2 K). Exemplary mandrel shapes for a given application will be known to those having skill in the art. For example, in an ADR system, the mandrel can be a cylindrical tube. Other configurations of the mandrel would be used to establish a desired configuration for the finished magnet.

An insulating layer (not shown) is added to the area of the mandrel 12 upon which the superconducting wire 14 will be wound. This area is referred to as the central or winding region (e.g., smaller diameter area) of the mandrel 12. As mentioned above, the mandrel 12 can be metal to provide good thermal contact with the wire and heat sink. It is important, however, that wire is prevented from shorting to the mandrel. Part of the prevention comes from careful winding of the superconducting wire 14, but expansion and contraction as well as movement, denting, or the like to the magnet can short the wire to the mandrel. It is advantageous, therefore, to coat the central region of the mandrel with a layer of insulating material. The insulating materials used herein will electrically insulate the superconducting wires from the mandrel as the wire is wound on. Exemplary layers can be film, tape, paint, and other like layers of insulating material. In an exemplary embodiment, a layer of Kapton® tape is wound around the mandrel. Kapton® tape is a polyimide film commercially available from DuPont®. The polyimide film has good thermal cycling properties, temperature stability and operating range that is suitable for cryogenic systems, such as ADR systems. Moreover, Kapton® tape provides an added benefit to the insulating layer in that it provides compressive properties under the load of the wound superconducting wires 14. As the magnet 10 cools and the mandrel 12 contracts, the Kapton® tape springs back and maintains some load, and therefore thermal contact, between the superconducting wire turns 14 and the mandrel 12.

As will be described in more detail below, the superconducting wire 14 is wound around the central region of the mandrel 12. The wire 14 comprises a superconducting magnetic material. In some embodiments, it may be possible to use more than one superconducting wire of the same or different material. In an exemplary embodiment, the superconducting material is niobium-titanium (NbTi). In another exemplary embodiment, the wire 14 is a small diameter, multifilamentary wire. The multifilamentary wire can comprise a plurality of NbTi filaments disposed in a conductive metal matrix, e.g. copper. The conductive metal matrix, providing a cover to the NbTi filaments, can then be covered with an insulating sheath. Such a construction for the wire 14 is well known by those having skill in the art, an exemplary embodiment of which is commercially available from Supercon, Inc., located in Shrewsbury, Mass. The superconducting wire can have about 10 to about 20 filaments. Current is shared among the filaments in general. However, during normal operations such as ramping the magnetic field, there will be local heating of the superconductor, sufficient to turn the superconductor normal. In multifilamentary wire, this will occur on a filament by filament basis, and when it does, the current will shift into the other filaments. The affected filament will recover very quickly, and resume carrying supercurrent. As a result, multifilamentary wire can be more stable for use in large field magnets, allowing much higher field levels and ramp rates. An exemplary wire diameter is about 0.001 inches to about 0.01 inches (25 micrometers (μm) to about 25 millimeters (mm)); specifically 0.0025 inches to about 0.0075 inches (63.5 μm to 190.5 μm); and more specifically about 0.004 inches (101.6 μm). An exemplary superconducting wire commercially available from Supercon, Inc. has a diameter of 0.004 inches including the insulating sheath; 0.001 inches of the diameter being the sheath and 0.003 inches of the diameter being 15 NbTi filaments disposed in the copper cover. The wire of such diameter can be wound around the mandrel 12 about 60,000 to about 120,000 times to form the superconducting magnet. The diameter of the wire dictates winding densities and, consequently, field-to-current ratios. The actual number of winds will depend in part upon the diameter of the wire, the tension with which the wire is wound, and the length and diameter of the mandrel, specifically in the central/winding region. As mentioned previously, exemplary turns per length of the magnet are about 3,000 to about 20,000 turns per centimeter; specifically about 7,000 to about 14,000 turns per centimeter. Packing density is also an important consideration in order to keep the thickness of the windings, and the volume of the magnetic shielding needed, to a minimum. Therefore, the superconducting magnets as described herein have a packing density of about 5,000 to about 15,000 turns per square centimeter; specifically 10,000 turns per square centimeter of cross-section. The wire is wound in an abutting relationship to previous winds or turns. A potting material 16 is applied to each wind or layer, depending on technique.

Figure 2:
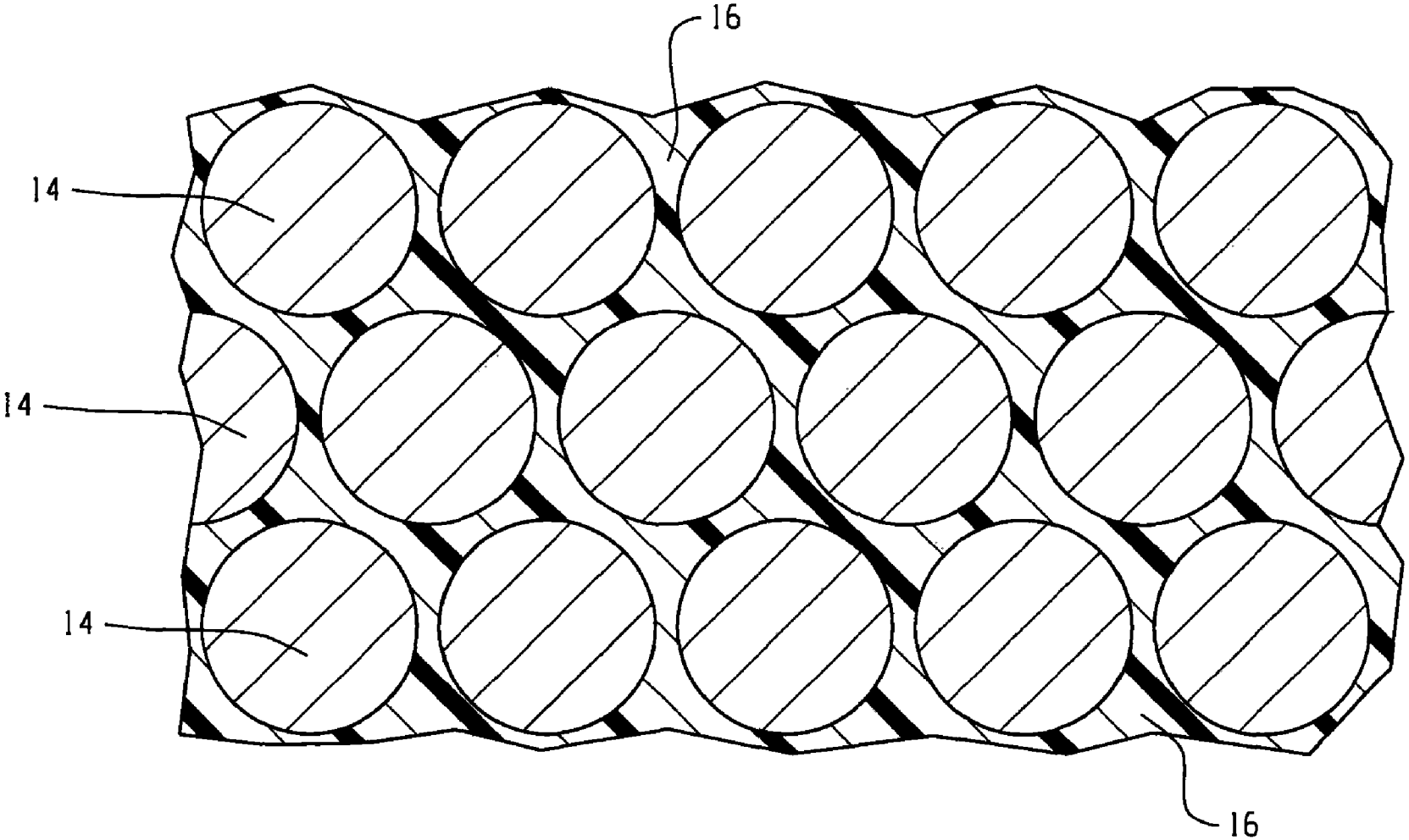
FIG. 2 is a schematic diagram of a cross-section of the superconducting magnet of FIG. 1, illustrating the superconducting wires and potting material.

The potting material 16 is configured to provide a thermal path between winds of the wire so as to provide plural and parallel paths for the dissipation of heat as such is generated at any location within the magnet. Magnets generate heat as they are ramped up and down. If that heat is not efficiently removed, then the magnet temperature rises and can cause a quench. The potting material 16 fills substantially all interstices between winds of the wire and thermally locks all of the windings together to the magnet mandrel 12. FIG. 2 illustrates an exemplary embodiment of a magnet cross-section showing the potting material 16 disposed in between the interstices of adjacent wire 14 turns and between each layer of wire wound about the mandrel. Exemplary potting materials will adhere to the superconducting wire, be able to withstand the operating temperature range for a given magnet application, and have similar thermal contraction properties to that of the superconducting wire filaments. In an exemplary embodiment, the potting material 16 is an epoxy adhesive. Epoxies used as potting materials in magnets are well known in the art, and a person having skill in the art will be able to determine the most suitable epoxy for a given magnet and magnet application. For example, for cryogenic applications such as ADR systems, the epoxy should have a broad performance temperature range, including high strain at cryogenic temperatures. Exemplary epoxy adhesives are those commercially available from Composite Technology Development, Inc. in Lafayette, Colo. In one embodiment, the potting material 16 is CTD-521 epoxy, used for its matched thermal contraction with NbTi filaments.

During winding, opposite ends of the superconducting wire 14 is brought to a common location and form the electrical leads 18 of the magnet 10, whereby the magnet can be in electrical communication with a power source. When a quench occurs, a voltage spike occurs that is proportional to the inductance of the winding and the rate of change of current through the winding. This voltage surge can be very damaging to the superconducting wire 14 of the magnet 10, since it can be on the order of several thousand volts. Protection against the voltage surge can be accomplished by "shunting" the superconducting wire 14 with a voltage limiting device. Due to the proximity of the electrical leads 18, the protection device is easily introduced into the magnet 10. In the exemplary embodiment of FIG. 1, the voltage limiting device is a pair of back-to-back diodes, e.g. 22, 24. The diodes 22, 24 are configured to protect the magnet 10 from quenches during operation. The diodes 22, 24 are disposed in a pocket 26 that is formed (e.g. machined) in an end of the mandrel 12. The leads 18 pass through the pocket 26 between the diodes 22, 24. The lead portions of the superconducting wire 14 are stripped (i.e., the insulating sheath removed) and soldered to the diodes. The positioning of the diodes 22, 24 in the pocket 26 allow for the maximum packing density (e.g. number of windings) by not occupying useable space in the mandrel winding region. Moreover, the pocket 26 allows the diodes to be adhered to the mandrel with potting material. In one embodiment, the potting material is the same as the potting material 16 used with the superconducting wire 14. In another embodiment, a different potting material is used with the diodes. The diode potting material secures the diodes into the pocket 26. Moreover, the diodes 22, 24 generate heat when they are activated, so the potting material aids in thermally dissipating that heat to the mandrel and, ultimately, the heat sink.

The wire leads 18 can then be wound around two bobbins 28 attached to an end of the mandrel 12. In one embodiment, the wire leads 18 are the ends of the super conducting wire and extend from the bobbins 28 and attach to a power source. In another embodiment, the superconducting wire leads 18 are transitioned to larger diameter wires that are then connected to the power source. Such a configuration is useful in magnets where superconducting wire is so small that it is fragile and can burn up if a quench initiates in the leads (e.g., due to excessive heating at a solder joint). The superconducting wire leads 18 can be transitioned to a larger diameter wire. An exemplary larger diameter wire could be 1 mm diameter monofilamentary NbTi wire. The transition is accomplished by wrapping each of the smaller diameter wires 18 around one of the two bobbins 28 on top of the mandrel 12 and soldering the wires 18 in place. The larger diameter wire are then disposed in electrical communication with the smaller diameter wires 18. In one embodiment, the larger diameter wires are wrapped around the smaller diameter wires 18 on the bobbins and soldered into place. The solder can be superconducting and the resistance through the copper cladding (as described above) of each wire type is very small. In a particular embodiment, the larger diameter wire is not only wrapped around the bobbin, but it also extends down to the diodes 22, 24 where the smaller diameter wires 18 connect. Consequently, there are two conducting paths from the diodes 22, 24 to the bobbins 28. In normal operation, the current is carried from the power source to the bobbins 28 by the larger diameter wire, and from the bobbins 28 to the magnet windings, past the diodes 22, 24, by the smaller diameter wires 18. In a quench situation (or if the power source were interrupted, e.g., unplugged), the diodes activate and the current is shunted by the diodes using only the smaller diameter wire on the magnet side. However, in a case where the power source provides a current surge or excessive voltage which activates the diodes, the dissipation in the diodes will quickly turn the leads of the magnet normal. In such a case, if the current has to travel through only the smaller diameter wires to the diodes, it is possible that those wires will burn up. The extra path for the current provided by the larger diameter wires will carry the current without damage.

Figure 3:
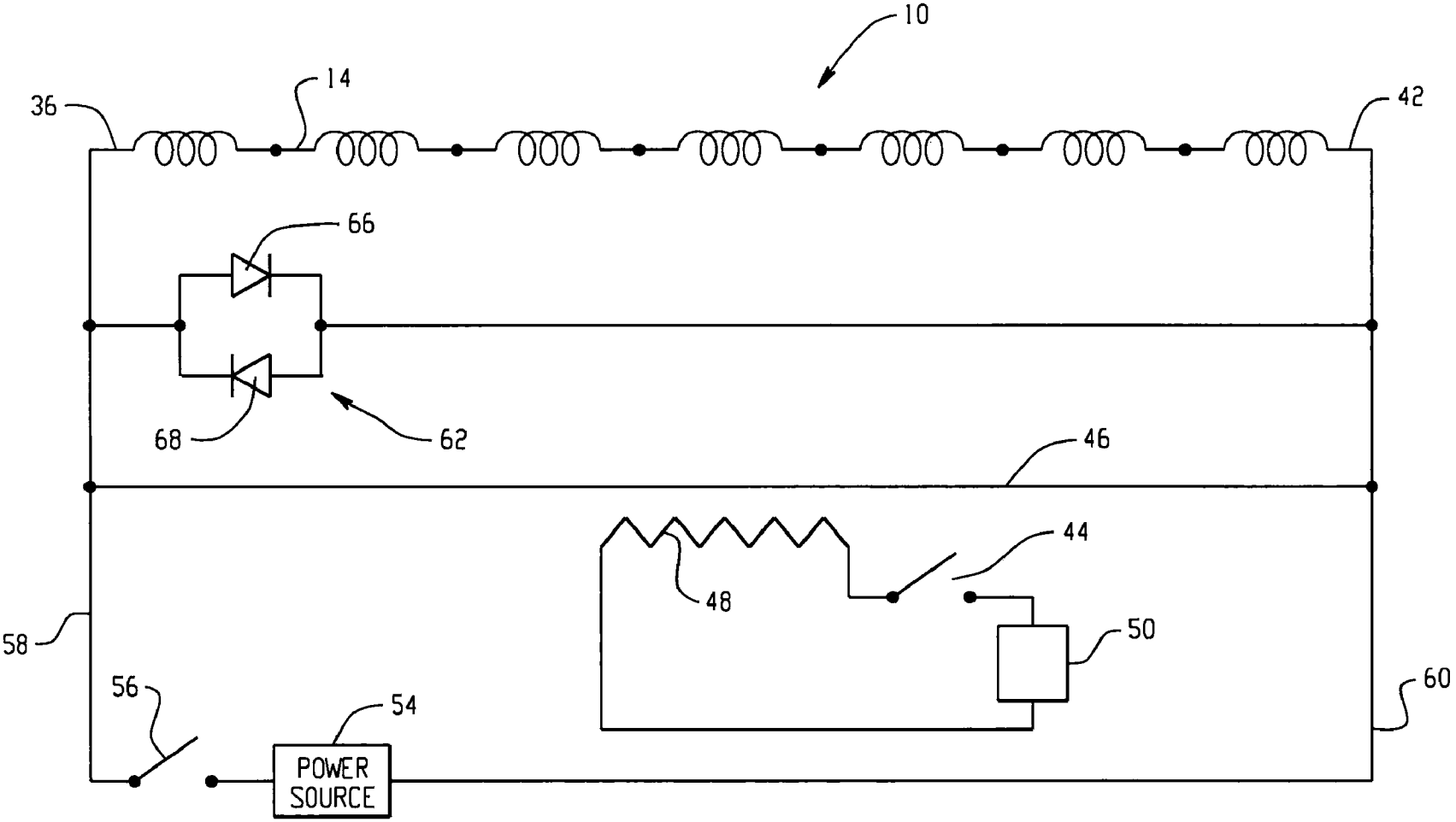
FIG. 3 is a schematic diagram illustrating the superconducting magnet in electrical communication with a power source and provided with an exemplary embodiment of a voltage limiting device.

FIG. 3 schematically illustrates the superconducting magnet 10 in communication with a conventional power system. The first lead 36 of the superconducting wire 14 is configured to introduce current to the magnet. The second lead 42 of the superconducting wire 14 completes the circuit to the magnet. The magnet 10 has a typical persistent switch 44 made up of a shunt 46, a heater 48, a power supply 50. This construction will be known to those having skill in the art and will take on a configuration desired by the user of the magnet. Furthermore, the magnet 10 is initially charged by a conventional power source 54, having an appropriate switch 56, with the power source leads 58 and 60 supplying power to the magnet via the magnet leads 36, 42. In the illustrated embodiment, the voltage limiting device 62 is a pair of back-to-back diodes 66, 68 in electrical communication with the magnet 10.

The superconducting magnet 10 as described herein has physical dimensions making it suitable for use in space industry applications, such as aerospace ADR systems. In particular, the superconducting magnet 10 can operate in vacuum. Also, the superconducting magnet 10 is small enough to surround the relatively small volume of refrigerant material used in the continuous ADR systems currently being developed. Moreover, despite the superconducting magnet's size, it is able to deliver a field-to-current ratio higher than that of current commercially available superconducting magnets that are physically too large for these systems. Even further, the reduced size of the magnet also helps to lower the total mass of the ADR system in which one or more of the magnets are disposed. Total mass is a crucial consideration for any space mission. In an exemplary embodiment, the superconducting magnet 10 has an outer diameter about 4 centimeters (cm) to about 8 cm; specifically about 5 cm to about 6 cm. The outer diameter of the magnet can be measured across the wiring region or the mandrel ends. In some embodiments, the entire magnet length has a uniform diameter. In other embodiments, the ends of the mandrel have an outer diameter that is greater than the outer diameter of the winding region where the superconducting wire is wound. In still another embodiment, the winding region has an outer diameter that is greater than the outer diameter for the ends of the mandrel. For embodiments where the mandrel is a cylindrical tube, the inner diameter can be about 1 cm to about 4 cm; specifically about 2 cm to about 3 cm; and more specifically about 2.5 cm. In an exemplary embodiment, the magnet has a length of about 4 cm to about 12 cm; specifically about 6 cm to about 10 cm; and more specifically about 8 cm.

In order to produce the superconducting magnet described herein, a specific method is employed to create a magnet with the desired field-to-current ratio in the desired minimal dimensions. In an exemplary embodiment, as mentioned above, a mandrel is first wrapped with an insulating layer, such as Kapton® tape. At least the portion of the mandrel where the wire will be wound (i.e., the central/winding region) is substantially completely covered by the insulating layer so as to electrically insulate the wire from the mandrel.

The superconducting wire is then wound about at least the central/winding region of the mandrel. In one embodiment, a coil winding machine is in operative communication with a supply spool of the desired superconducting wire. The coil winding machine is configured to spool the superconducting wire onto the mandrel at a predetermined speed and tension for the wire diameter chosen and the packing density desired for the magnet. Exemplary coil winding machines are those commercially available machines with adjustable spooling speed and the ability to feed wires of the diameters described herein. The desired spool speed (e.g. feed rate) for winding the wire onto the mandrel is determined by the tensile strength of the wire, and in some part by the ability to adequately apply the potting material to the wire as its wound onto the mandrel. Correctly tensioning the wire as it spools onto the mandrel is important to ensure that the wire retains thermal contact with the mandrel as the magnet cools down. Moreover, careful winding of the small diameter wire at the predetermined tension enables a higher packing density for the magnet. As stated previously, the superconducting magnets described herein can have a packing density of about 5,000 to about 15,000 turns per square centimeter; specifically 10,000 turns per square centimeter of cross-section. In an exemplary embodiment, for a 0.003 inch NbTi superconducting wire as described above, the tension is set from about 0.1 to about 0.4 lbs; specifically about 0.2 to about 0.3 lbs; and more specifically about 0.25 lbs. Again, the tension will be adjusted based on the tensile strength of the wire, sensitivity of the coil winding machine, and the like.

The potting material is applied to every layer of the superconducting wire that is wrapped around the mandrel. The potting material may be applied in any manner effective to ensure adherence between each wind of wire and provide thermal conduction across the layers and to the mandrel. In one embodiment, the potting material can be brushed over each layer of wire as the mandrel is wound. In another embodiment, the epoxy can be applied to the individual wire as it departs the coil winding machine and is wound onto the mandrel. In embodiments where a liquid/wet epoxy or other adhesive is applied, the epoxy is allowed to dry and/or cure before the magnet undergoes further processing.

After winding and application of the potting material, each end of the superconducting wire is terminated. As mentioned above, a pocket is formed in an end of the mandrel through which the leads can pass and terminate. The pocket can be formed by any method known to those having skill in the art, such as by stamping, machining, cutting, and the like. A voltage limiting device, such as a pair of back-to-back diodes, is inserted into the pocket and the leads pass between the device to shunt the current in case of a quench condition in the magnet. In some embodiments, it may be necessary to remove the insulating sheath from the leads and solder the wire to the diodes for permanent, secure connection. The diodes can be activated automatically when the voltage begins to increase at a certain rate or attains a predetermined value to prevent damage to the magnet.

The superconducting magnet described herein provides very high field-to-current ratios at an advantageously compact size. This magnet represents an improvement over existing superconducting magnets, because it is able to achieve higher field-to-current ratios than is available from current magnets, and it is able to do so at a significantly smaller size. In an exemplary embodiment, the superconducting magnet has a field-to-current ratio of equal to or greater than 1.1 Tesla per ampere (T/A); specifically equal to or greater than 1.2 T/A; more specifically equal to or greater than 1.3 T/A; even more specifically equal to or greater than 1.4 T/A; even more specifically equal to or greater than 1.5 T/A; and still more specifically equal to or greater than 1.55 T/A. The superconducting magnet described herein also requires less magnetic shielding to reduce fringing fields, can be cooled down rapidly without risk of damaging the wiring, can be ramped up and down in field at very high rates, generates a minimum amount of hysteresis heat, and because less current is required to generate a given magnetic field, the heat load upon a cryogenic system from the leads is minimized. As such, the superconducting magnet can be advantageously used in any system that requires a superconducting magnet or that would benefit from such high magnetic fields at low current. In an exemplary embodiment, one or more superconducting magnets are used in an ADR system, particularly those ADR systems employed in space applications. In particular, the superconducting magnet can operate in vacuum and is small enough to surround the relatively small volume of refrigerant material used in the continuous ADR systems currently being developed. Also, the reduced size of the magnet helps to lower the total mass of the ADR system.

The terminology used herein is for the purpose of describing particular embodiments only and is not intended to be limiting of the invention. Ranges disclosed herein are inclusive and combinable (e.g., ranges of "up to about 25 vol %, or, more specifically, about 5 vol % to about 20 vol %", is inclusive of the endpoints and all intermediate values of the ranges of "about 5 vol % to about 25 vol %," etc.). "Combination" is inclusive of blends, mixtures, alloys, reaction products, and the like. Furthermore, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by context, (e.g., includes the degree of error associated with measurement of the particular quantity). The suffix "(s)" as used herein is intended to include both the singular and the plural of the term that it modifies, thereby including one or more of that term (e.g., the colorant(s) includes one or more colorants). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

Unless otherwise defined, all terms (including technical and scientific terms) used herein have the same meaning as commonly understood by one of ordinary skill in the art to which the embodiments of the invention belong. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A superconducting magnet, comprising:

an electrically insulating layer disposed about the surface of a mandrel;

a superconducting wire wound in adjacent turns about the mandrel to form the superconducting magnet, wherein the superconducting wire is in thermal communication with the mandrel, and the superconducting magnet has a field-to-current ratio equal to or greater than 1.1 Tesla per Ampere;

a thermally conductive potting material configured to fill interstices between the adjacent turns, wherein the thermally conductive potting material and the superconducting wire provide a path for dissipation of heat; and a voltage limiting device disposed across each end of the superconducting wire, wherein the voltage limiting device is configured to prevent a voltage excursion across the superconducting wire during quench of the superconducting magnet.

2. The magnet of claim 1, wherein the superconducting wire comprises a plurality of niobium-titanium filaments disposed in a copper matrix having an electrically insulating sheath disposed thereabout.

3. The magnet of claim 2, wherein the superconducting wire has an outer diameter of 25 micrometers to about 0.25 millimeters.

4. The magnet of claim 2, wherein the superconducting wire comprises about 10 to about 20 niobium-titanium filaments.

5. The magnet of claim 1, wherein the superconducting wire is wound about 3,000 to about 20,000 turns per centimeter on the mandrel.

6. The magnet of claim 1, wherein the superconducting wire is wind on the mandrel at a packing density of about 5,000 to about 15,000 turns per square centimeter.

7. The magnet of claim 1, wherein the voltage limiting device is disposed in a pocket located in an end of the mandrel.

8. The magnet of claim 7, wherein a thermally conductive potting material substantially fills the pocket around the voltage limiting device.

9. The magnet of claim 1, wherein the voltage limiting device is a pair of diodes connected in a back-to-back array across the ends of the superconducting wire.

10. The magnet of claim 1, wherein the mandrel comprises a cylindrical tube of an electrically conductive, non-magnetic metal.

11. The magnet of claim 10, wherein the superconducting magnet has an outer diameter of about 4 centimeters to about 8 centimeters.

12. The magnet of claim 10, wherein the superconducting magnet has an inner diameter of about 1 centimeter to about 4 centimeters.

13. The magnet of claim 1, wherein the superconducting magnet has a length of about 4 centimeters to about 12 centimeters.

14. The magnet of claim 1, wherein the superconducting magnet has a field-to-current ratio equal to or greater than 1.3 Tesla per Ampere.

15. The magnet of claim 1, wherein the superconducting magnet has a field-to-current ratio equal to or greater than 1.5 Tesla per Ampere.

16. The magnet of claim 1, wherein the ends of the superconducting wire are in electrical communication with a wire of larger diameter than the diameter of the superconducting wire, wherein the larger diameter wire is also in electrical communication with a power source.

17. The magnet of claim 9, wherein a wire of larger diameter than the diameter of the superconducting wire is in electrical communication with the pair of diodes, and wherein the larger diameter wire is also in electrical communication with a power source.

18. An adiabatic demagnetization refrigerator system comprising the superconducting magnet of claim 1.

19. A method of making a superconducting magnet, comprising:

covering a surface of a mandrel with an electrically insulating layer;

winding a superconducting wire over the insulating layer onto the mandrel;

simultaneously with the winding of the superconducting wire, filling interstices between each wind with a thermally conductive potting material; and connecting a voltage limiting device across each end of the superconducting wire to form the superconducting magnet, wherein the superconducting magnet has a field-to-current ratio equal to or greater than 1.1 Tesla per Ampere.

20. The method of claim 19, further comprising holding the superconducting wire at a tension of about 0.1 pounds to about 0.4 pounds during the winding.

* * * * *